United States Patent [19]

Simons

[11] 4,274,455

[45] Jun. 23, 1981

[54] TONER LOADING DEVICE

[75] Inventor: Peter B. Simons, Los Altos, Calif.

[73] Assignee: TBS, Inc., Mountain View, Calif.

[21] Appl. No.: 29,687

[22] Filed: Apr. 13, 1979

[51] Int. Cl.[3] ..... B65B 1/04; B67C 9/00

[52] U.S. Cl. ..... 141/1; 141/114; 141/327; 141/380; 138/89; 138/103; 138/121

[58] Field of Search ..... 138/121, 122, 103, 89; 141/1, 114, 325, 326, 327, 369, 379, 380, 381, 382–389, 311 R, 392, 18–26, 2, 98; 220/254

[56] References Cited

U.S. PATENT DOCUMENTS

| | | | |
|---|---|---|---|
| 2,337,320 | 12/1943 | Elliott | 138/89 |
| 2,365,181 | 12/1944 | Fentress | 138/89 |
| 4,137,647 | 2/1979 | Clark | 138/89 |

FOREIGN PATENT DOCUMENTS

| | | | |
|---|---|---|---|
| 448477 | 5/1948 | Canada | 138/89 |

*Primary Examiner*—Houston S. Bell, Jr.

[57] ABSTRACT

The device comprises a flexible, expandable hose which has a coupling at one end for mating with the toner hopper of either of a photocopy machine or a computer print-out machine, the other end of the hose having a coupling for mating with the neck of the toner canister so that toner may be loaded from the canister into the hose from outside of the machine which uses the toner, the toner canister is then removed from attachment to the hose, the hose is capped and the hose is compressed, whereby the toner is loaded into the machine with minimal spillage.

6 Claims, 4 Drawing Figures

TONER LOADING DEVICE

BACKGROUND OF THE INVENTION

The invention relates to a device and method for loading toner and more particularly to an adapter for manually loading toner into either a photocopy machine or a computer print-out machine.

Present day computer print-out machines use a carbon type toner as the print medium. This toner is similar to that used in xerographic type photocopy machines. One such type of machine presently utilizes a flat plastic tube which is sealed at one end, filled with toner, closed at its opposite end with a removable clip and at this same end is provided with an adapter which mates with the toner hopper of the machine. In order to load toner into the machine the tube must be attached to the machine, which requires working within a confined space in the machine, and then the clip is removed from the tube. The toner is then shaken out of the tube into the machine and the tube is subsequently removed from attachment to the machine.

Common problems with this existing type of toner loading device are that the bags are subject to rupture during shipping or puncture during loading into the machine. A second problem is that the toner hopper is inside of the machine. Because of the confined working space it is not infrequent that the operator removes the clip from the tube before attaching the tube to the machine. This results in a certain amount of spillage during the coupling of the tube into the toner hopper.

SUMMARY OF THE INVENTION

The above and other disadvantages of prior art toner loading systems are overcome by the present invention of apparatus for manually loading toner into a machine, the apparatus comprising a flexible, expandable hose, the hose having a fitting on one end for removably coupling it to the machine, and a fitting on the other end of the hose for removably coupling the hose to a toner canister which is exterior to the machine. A close fitting cap is also provided for sealing the end of the hose after it is detached from the canister. The hose adapter is designed so that its couplings will mate with existing toner canisters and machines. In the preferred embodiment the hose has a male coupling for mating with the machine and a female coupling which attaches over the neck of the toner canister in place of the cap which normally seals the toner canister.

Because the tube is expandable in a lengthwise direction, the method of loading toner into the machine utilizing the invention is as follows. The hose is first screwed into the toner hopper of the machine and is then expanded lengthwise until the opposite end of the hose is exterior to the machine. Tilting the hose end downwardly, the canister is screwed into the free end of the hose until it seals therewith. The canister is then inverted, while simultaneously holding the hose in its expanded position, and the toner is emptied from the canister into the hose. The emptied canister is now removed and the end of the hose is sealed with a cap attached by a chain or lanyard attached to the hose. The hose is then compressed back into the machine while it is manually shaken, to thereby empty the residual toner within the hose into the toner hopper of the machine. The sealed off hose is then simply left within the machine, assuming that it does not interfere with the operation of the machine, until reloading is necessary. In those machines where it is necessary to remove the hose this can easily be done simply by unscrewing the hose from the machine. The advantage of this operation over prior art operations is that the attachment within the cramped working space of the machine can be made with the hose prior to its connection to the toner canister, thereby minimizing the amount of spillage. In prior art devices this was not possible since the toner container attached directly to the machine.

It is therefore an object of the present invention to provide apparatus for loading toner from a rigid, bulky toner canister into a machine.

It is another object of the invention to provide apparatus for easily, manually loading toner into a machine having a cramped working space.

It is still another object of the invention to provide apparatus for manually loading toner into a machine with a minimum of toner spillage.

The foregoing and other objectives, features and advantages of the invention will be more readily understood upon consideration of the following detailed description of the preferred embodiment of the invention, taken in conjunction with the accompanying drawings.

DETAILED DESCRIPTION OF THE PREFERRED EMBODIMENT

Figure 1:
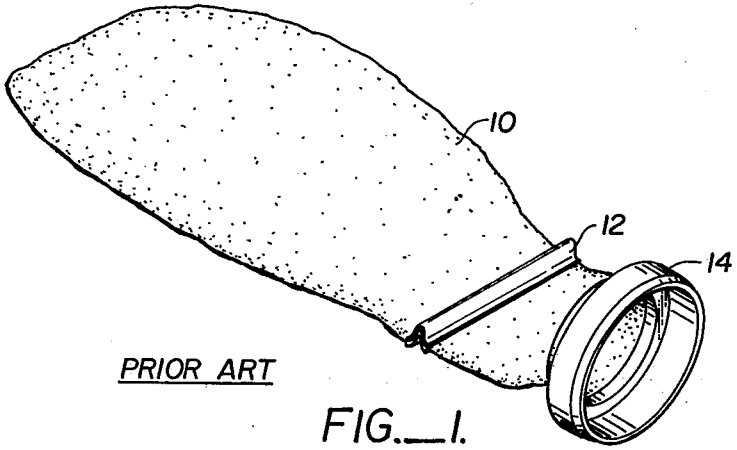
PRIOR ART FIG. 1.
FIG. 1 is a perspective view of a prior art toner loading device.

Referring now more particularly to FIG. 1 the prior art toner loading apparatus is illustrated. In this apparatus a plastic bag 10 is sealed at one end and filled with toner. The other end of the bag 10 is sealed by means of a removable clip 12 and is connected to a fitting 14 which mates with a corresponding fitting of the toner hopper mechanism within the machine (not shown). In order to load toner into the machine the fitting 14 is coupled to the corresponding fitting in the machine and then the clip 12 is removed. Thereafter the operator shakes the bag 10 to force all of the toner within it into the machine. The problem has been that because of cramped space within the machine it is difficult to firmly mate the coupling 14 with the machine without spilling any toner in the process. Typically the coupling 14 must be screwed onto a corresponding fitting and this is difficult to do with a bag which may be as long as three feet and weigh as much as two and one-half to three pounds. Also, such bags are subject to puncture during shipment or during loading of the toner into the machine. Still another problem has been that operators frequently remove the clip 12 before the coupling 14 is attached to the machine because there is insufficient space within the machine to easily remove the clip once the coupling 14 has been mated to the machine. In the process of screwing the coupling 14 onto the corresponding fitting within the machine with the clip 12 removed toner material often spills out of the container. Such toner is extremely messy and difficult to clean up.

Figure 2:
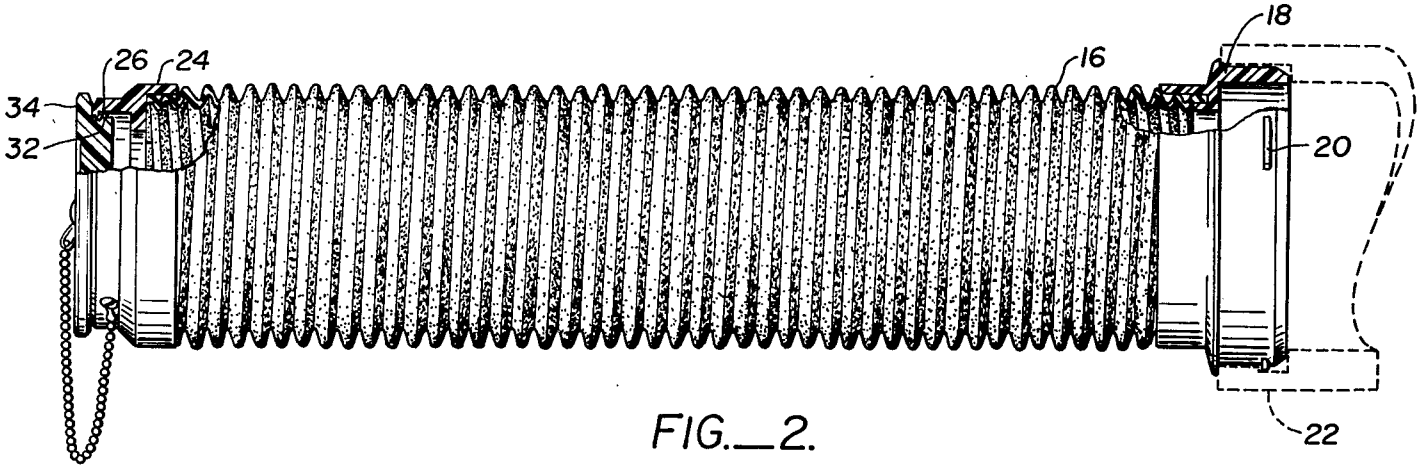
FIG. 2 is a vertical, elevational view with portions broken away and in section of the toner loading device according to the invention.
Figure 3:
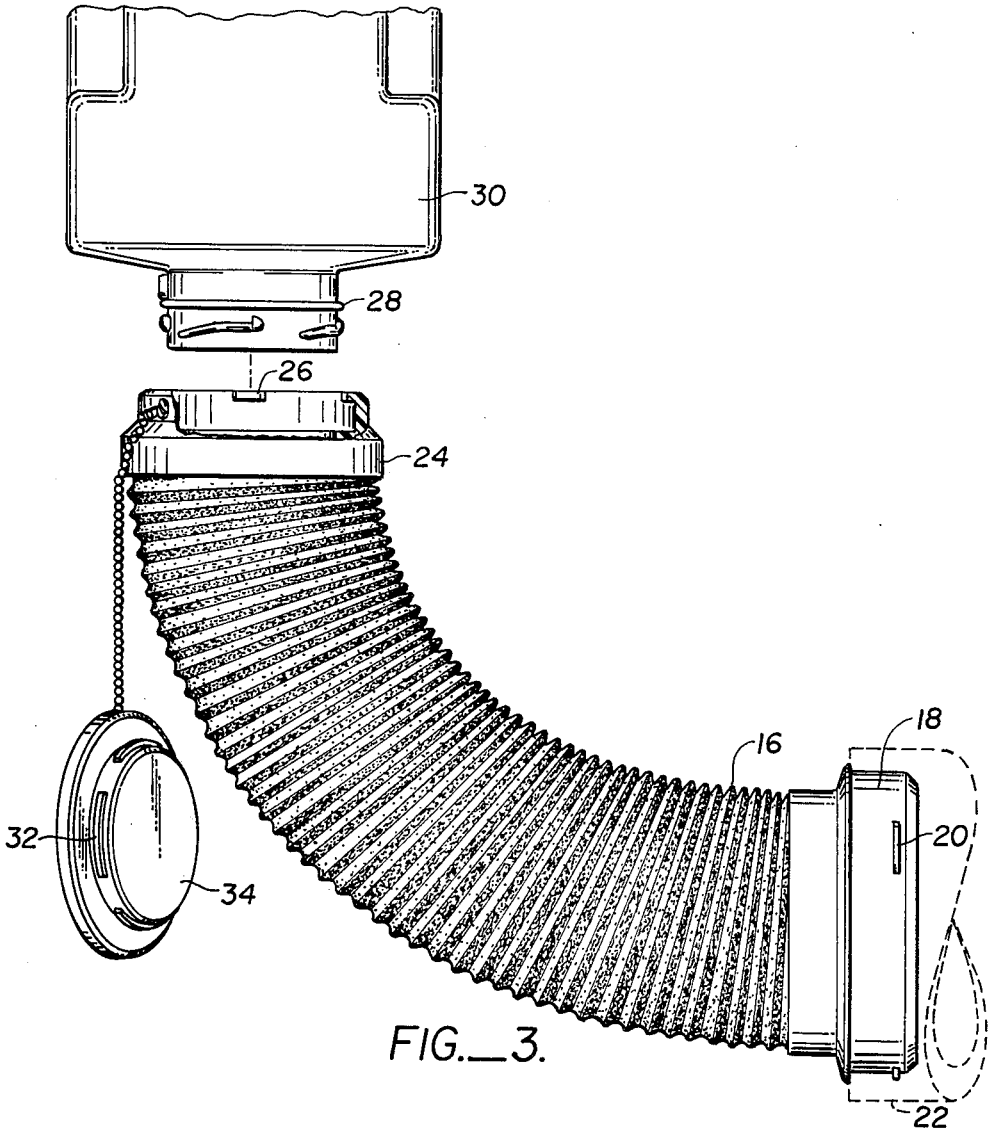
FIG. 3 is a vertical, elevational view of the toner loading device according to the invention shown in its expanded form, together with a toner canister.

Referring now more particularly to FIG. 2 the toner loading apparatus according to the invention as illustrated. The apparatus comprises an expandable tube or hose 16 made of a heavy-duty plastic material. One end of the hose 16 is fitted with a male coupling 18 having protruding lugs 20 from its circumference. The fitting 18 is adapted to mate with a corresponding, threaded female coupling 22 (shown in phantom line) of the toner hopper of the machine which is intended to utilize the toner material. The opposite end of the hose 16 is provided with a female coupling 24 which is also provided with protruding lugs 26 on the interior surface of the coupling 24. As best shown in FIG. 3 these lugs are intended to threadably engage the threaded neck 28 of a toner canister 30. In the alternative, the lugs 26 are also adapted to engage corresponding lugs 32 of an end closure cap 34 as will be explained in greater detail hereinafter. The hose as it is illustrated in FIG. 2 is in its expanded form, that is it is stretched lengthwise.

Figure 4:
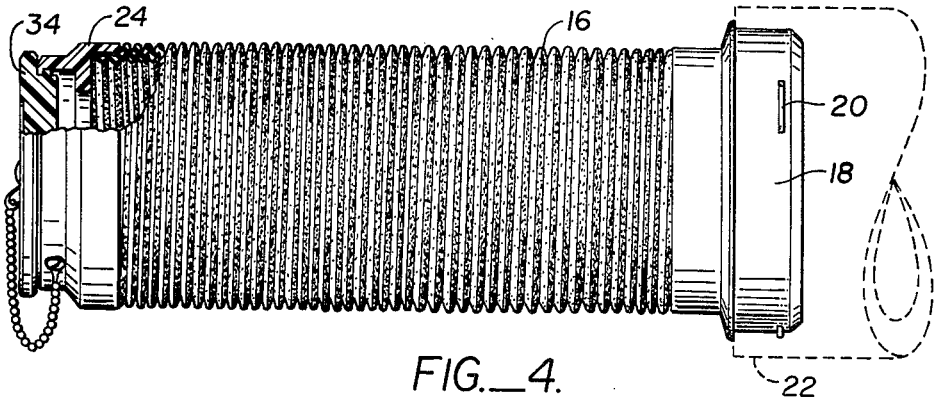
FIG. 4 is a vertical, elevational view with portions broken away and in section of the toner loading device of the invention in its compressed form.

In order to use the apparatus according to the invention coupling 18 of the hose 16 is threaded into the matching coupling 22 of the machine. The hose 16 is then extended or expanded lengthwise out of the machine. A canister 30 containing toner and having a neck 28 is threaded into the female coupling 24 while the hose 16 is bent in a 90-degree downward direction (that is, the opposite from the position shown in FIG. 3). The canister 30 is then turned upside down while coupled to the hose until the hose 16 is bent in a 90-degree upward direction as illustrated in FIG. 3. When the canister 30 is completely emptied into the hose 16 it is removed, as illustrated in FIG. 3, by unscrewing it from the coupling 24. The cap 34 is then screwed into the open end of the coupling 24 and the hose is then manually shaken and compressed as illustrated in FIG. 4. This causes any residual toner which has not yet been loaded into the machine 22 to be forced out of the hose 16 and into the machine. The tube or hose 16 can be left attached to the machine or it can simply be removed by unscrewing the coupling 18 from the machine coupling 22.

With the apparatus of the invention it is thus unnecessary to try to work with a bulky toner canister within the close confines of the machine nor is it necessary to try to engage an open toner canister with the machine in a position which is likely to spill the toner out of the canister.

The terms and expressions which have been employed here are used in terms of description and not of limitation, and there is no intention, and the use of such terms and expressions of excluding equivalents of the features shown and described, or portions thereof, it being recognized that various modifications are possible within the scope of the invention claimed.

What is claimed is:

1. A method of loading toner from a canister into a machine of the type having a toner hopper, the method comprising the steps of:

removably connecting one end of an expandable hose to the machine to empty into the hopper, removably connecting the other end of the hose to the toner canister;

stretching the hose from the machine while simultaneously emptying the canister into the hose, detaching the canister from the hose, closing off the hose end which has been detached from the canister, and compressing the hose in the direction of its length while simultaneously emptying the bulk of the toner within the hose into the hopper.

2. The method as recited in claim 1 wherein the step of connecting the end of the hose to the toner canister comprises the step of:

threading the canister into the open end of the hose with the canister held with its open end vertically upright so that no toner leaves the canister during the coupling step.

3. The method as recited in claim 1 wherein the machine has a threaded female socket, the hose has a matching threaded male coupling, the toner canister is a bottle having a threaded neck and the hose has a matching female threaded coupling and wherein the step of attaching the hose to the machine comprises the step of screwing the hose end into the hopper female socket and attaching the canister to the hose comprises the step of threading the canister neck into the female coupling of the hose.

4. In combination with a toner canister and a machine having a toner hopper apparatus for loading toner from the canister into the machine, the apparatus comprising an expandable hose, means for removably connecting one end of the expandable hose to the machine to empty the hose contents into the hopper, means for removably connecting the other end of the hose to the toner canister, and means for closing off the other hose end when detached from the canister.

5. The combination as recited in claim 4 wherein the means for connecting the end of the hose to the toner canister comprises corresponding male and female threaded couplings on the other end of the hose and the canister for threadably connecting the canister into the open end of the hose with the canister held with its open end vertically upright so that no toner leaves the canister during the coupling step.

6. The combination as recited in claims 4 or 5 wherein the machine has a threaded female socket, the hose has a matching threaded male coupling, the toner canister is a bottle having a threaded neck and the hose has a matching female threaded coupling whereby the hose can be attached to the machine by screwing the hose end into the hopper female socket and the canister can be attached to the hose by threading the canister neck into the female coupling of the hose.

* * * * *